US005259358A

United States Patent [19]

Chen

[11] Patent Number: 5,259,358

[45] Date of Patent: Nov. 9, 1993

[54] AIR-FUEL RATIO CONTROL SYSTEM FOR CATALYTIC ENGINE EXHAUST EMISSION CONTROL

[75] Inventor: Tze-Ning Chen, Sudbury, Mass.

[73] Assignee: Gas Research Institute, Chicago, Ill.

[21] Appl. No.: 913,249

[22] Filed: Jul. 14, 1992

[51] Int. Cl.[5] ..... F02B 3/00

[52] U.S. Cl. ..... 123/697; 60/276; 204/408

[58] Field of Search ..... 123/697, 672, 689, 676; 73/23.32, 116, 118.1; 204/408, 431, 153.16, 195; 60/274, 276, 303

[56] References Cited

U.S. PATENT DOCUMENTS

| | | | |
|---|---|---|---|
| 3,616,274 | 10/1971 | Eddy | 204/195 |
| 3,979,905 | 9/1976 | Masaki et al. | 60/303 |
| 4,061,117 | 12/1977 | Ikeura | 60/276 |
| 4,129,099 | 12/1978 | Howarth | 60/276 |
| 4,283,261 | 8/1981 | Maurer et al. | 204/408 |
| 4,475,512 | 10/1984 | Suzuki et al. | 60/276 |
| 4,535,316 | 8/1985 | Wertheimer et al. | 72/23.32 |
| 4,708,777 | 11/1987 | Kuraoka | 60/276 |
| 4,721,084 | 1/1988 | Kawanabe et al. | 60/276 |
| 4,732,128 | 3/1988 | Yoshioka et al. | 123/697 |
| 4,752,361 | 6/1988 | Gautschi | 60/276 |
| 4,938,196 | 7/1990 | Hoshi et al. | 123/697 |
| 5,103,791 | 4/1992 | Tomisawa | 123/689 |
| 5,148,795 | 9/1992 | Nagai et al. | 123/697 |
| 5,168,701 | 12/1992 | Yamamoto et al. | 60/274 |

FOREIGN PATENT DOCUMENTS 1569948 6/1980 United Kingdom .

*Primary Examiner*—Tony M. Argenbright
*Assistant Examiner*—M. Macy
*Attorney, Agent, or Firm*—Lorusso & Loud

[57] ABSTRACT

A closed loop fuel control system for an internal combustion engine in which the temperature of the exhaust gases passing by the oxygen sensor are regulated. The system utilizes a heated oxygen sensor in a slipstream of the exhaust gas and the temperature of the exhaust gas is controlled prior to its passing by the heated oxygen sensor for maximum efficiency of the catalytic converter.

22 Claims, 3 Drawing Sheets

AIR-FUEL RATIO CONTROL SYSTEM FOR CATALYTIC ENGINE EXHAUST EMISSION CONTROL

BACKGROUND OF THE INVENTION

The present invention relates in general to internal combustion engines of automotive vehicles and internal combustion engines for driving stationary equipment, and specifically to a gasoline-powered or natural gas-powered automotive internal combustion engine of the type using a catalytic converter in the exhaust system for exhaust cleaning purposes.

For example, at present most automotive vehicles are equipped with catalytic converters in the exhaust systems of the engines for converting the toxic air contaminants in the exhaust emissions into harmless compounds. In a closed loop fuel control system for the internal combustion engine, control means adjust the mass flow rates of air and fuel entering the engine to the desired air-to-fuel ratio, preferably in a narrow range approaching stoichiometry, in the following manner.

The engine operates on a fuel-air mixture. A sensor is mounted within the exhaust pipe upstream of the catalytic converter. Exhaust gases emitted from the engine pass through the exhaust pipe where the sensor is exposed to them. (The exhaust gases are then passed through the catalytic converter into a tailpipe for entry into the atmosphere.) Leads from the sensor extend to an electronic control unit. The electronic control unit is responsive to the output voltage of the sensor and generates a control signal to be sent via leads to the air-fuel mixture control means. The air-fuel mixture control means responds to the control signal of the electronic control unit and regulates the mass flow rates of air and fuel introduced into the engine as it is directed.

These systems typically use a "three-way" catalyst which is especially effective to oxidize the unburned combustible compounds such as hydrocarbons (HC) and carbon monoxide(CO) contained in the exhaust gases emitted from the engine cylinders. The "three-way" catalyst not only promotes oxidation of these combustible compounds but is operable to reduce nitric oxides ($NO_x$) in the exhaust gases to $N_2$ if the exhaust gases to be processed by the catalyst have a chemical composition within a certain range which is dictated by the air-fuel ratio of the mixture supplied to the engine cylinders. Thus, the catalytic converter using the "three-way" catalyst provides triple effects to process the three most important kinds of air contaminative compounds in the exhaust gases when the air-to-fuel mixture supplied to the engine cylinders is proportioned to an air-to-fuel ratio within a certain range.

Experiments have revealed that it is in a narrow range containing the stoichiometric air-to-fuel ratio of about 14.8 to 1 (for a gasoline powered engine) or 17.0 to 1 (for a natural gas powered engine) that enables the triple effect or "three way" catalytic converter to produce its maximum conversion efficiency against the three most common types of air contaminative compounds.

Thus, the closed loop or feedback mixture control system involves an exhaust sensor operative to detect the concentration of a prescribed type of chemical component, normally oxygen, contained in the exhaust gases emitted from the engine cylinders and produces a signal indicative of the detected concentration of the chemical component. Control of the oxygen content of the exhaust gases by control of the mass flow rates of air and fuel introduced into the engine, within a fairly narrow range for automotive internal combustion engines, will optimize the performance efficiency of the catalytic converter.

The temperature of the exhaust gases from the engine can vary according to the power output and speed of the engine, as is well known in the art. The temperature of the oxygen sensor exposed to those exhaust gases varies in the same way as the temperature of the exhaust gases vary. If the temperature of the oxygen sensor is lower than the minimum operable level, for example about 600° F. for an electrochemical-type oxygen sensor, the oxygen sensor is unable to function and produce a signal accurately representing the oxygen content of the exhaust gases.

In the case where the exhaust gas temperature, and hence the oxygen sensor temperature, varies over a wide range, the accuracy of the sensor output is significantly affected because of its strong dependence on temperature. Even in situations in which the air-to-fuel ratio of the mixture is supplied to the engine cylinders at a constant set value, if the temperature of the exhaust gases, and hence the oxygen sensor temperature, is higher or lower than a predetermined level, the sensor output signal will deviate from the correct value. The deviation of the sensor output signal causes the control means to regulate the air-to-fuel ratio to a value different from the correct value. In such a situation, the total performances of the exhaust sensor and the closed loop control system are impaired and the effectiveness of the catalytic converter is reduced.

Thus, there has long been a need to minimize the temperature effects on the oxygen sensor of an internal combustion engine having a catalytic converter so that the only variable affecting the sensor is the oxygen content of the exhaust gases. If temperature effects on the oxygen sensor can be minimized, the signals from the oxygen sensor will accurately reflect the oxygen content of the fuel-air mixture, and the ratios of that mixture can be regulated for maximum efficiency of the catalytic converter.

It is therefore an object of the present invention to provide an improved system to control the air-to-fuel ratio of the mixture to be produced in the mixture supply system of an internal combustion engine of the type arranged with a catalytic converter so that the catalytic converter can produce at maximum efficiency against air contaminative compounds contained in exhaust gases from the engine cylinders.

It is another object of the present invention to provide a system in which the effects of variable exhaust gas temperatures on the sensor is reduced or effectively eliminated when the engine speed or load varies.

It is a further object of the present invention to provide a system that maintains the oxygen sensor at a reasonably constant temperature so that its output accurately represents the oxygen concentration in the exhaust gas.

SUMMARY OF THE INVENTION

The present invention is a system that reduces or eliminates the effects of variable temperatures of the exhaust gases on the oxygen sensor of an internal combustion engine so that the sensor's output signal accurately represents the oxygen concentration in the exhaust gas. When the output signal correctly reads the oxygen content of the exhaust gases, and is not affected by temperature and pressure variations of the exhaust gases, the control means will accurately regulate the air-to-fuel mixture so that the performance of the catalytic emission control system is optimized.

In the system of the present invention, the temperature of the exhaust gases and of the oxygen sensor are controlled. The apparatus of the present invention uses a heated oxygen sensor in a temperature-controlled slipstream of the exhaust gas. The temperature of the exhaust gas in the slipstream is controlled by a thermostatically controlled valve, which cools the exhaust gas to a temperature lower than the oxygen sensor. The flow rate of the slipstream of the exhaust gas may also be maintained by passing the gas in the slipstream through a pressure regulator and an orifice to reduce or eliminate the effect of variable flow rates of the gases on the temperature of the sensor. Regulation of the temperature of the slipstream of the exhaust gas results in a constant flow rate of constant temperature exhaust gas passing by the oxygen sensor and thus allows the sensor to operate at constant temperature and maximum accuracy in representing the oxygen concentration in the exhaust gases.

The object and features of the present invention will become more readily apparent from the following detailed description of the preferred embodiments taken in conjunction with the accompanying drawings in which like reference numbers refer to like members in the various views.

DETAILED DESCRIPTION OF THE INVENTION

The apparatus of the present invention improves the performance of the catalytic emission control system by maintaining the conditions in which the oxygen sensor operates at a predetermined constant. As a result of the use of such a system, the fuel-to-air mixture ratio can be controlled at a predetermined value and the performance of the catalytic emission control system will be improved.

Figure 1:
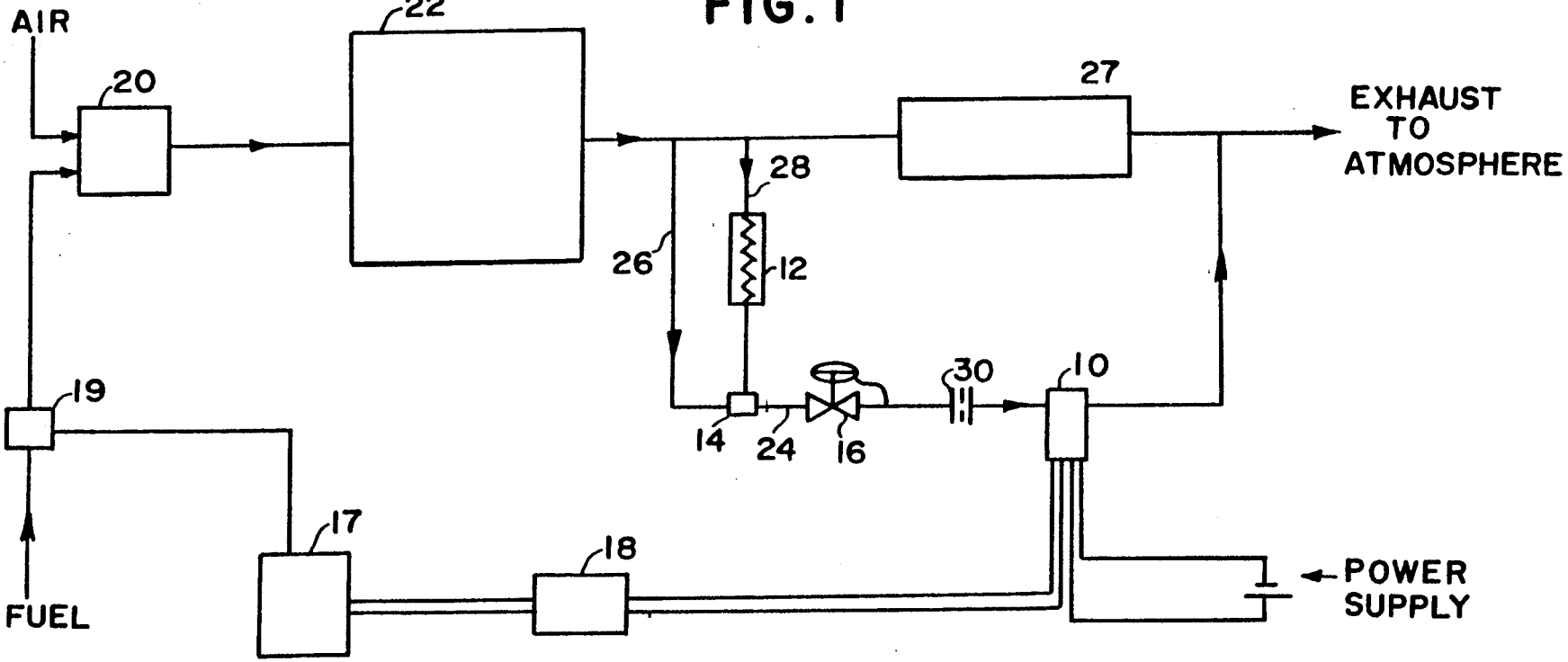
FIG. 1 is a schematic representation of an apparatus according to the present invention for improving the fuel-air ratio control and the effectiveness of the catalytic emission reduction system.

FIG. 1 is a schematic diagram of an apparatus according to the preferred embodiment of the present invention. In the system as shown, fuel is added to the air in the fuel-air mixer 20 prior to the fuel-to-air mixture being introduced into the engine 22, as is conventional in the art. Exhaust from the engine passes through the catalytic converter 27 and exhausts to the atmosphere.

The performance of a catalytic converter 27 is affected not only by the proportion between the air and fuel components in the air-fuel mixture supplied to the engine cylinders but by the temperature of the exhaust gases passed through the converter, as is well known in the art. If the temperature of the exhaust gases passed through the converter 27 is lower or higher than the predetermined level, the catalytic converter 27 is unable to produce its maximum conversion efficiency, despite proper air-to-fuel ratios.

According to the present invention, a portion of the exhaust stream is diverted into a slipstream 24. The slipstream 24 may be formed by, for example, duct means interconnected with the exhaust system such that only a small proportion of the exhaust gases, approximately 1 to 10%, pass through the duct means. It is only the exhaust gas in the slipstream 24 which passes by the oxygen sensor 10.

A significant feature of the system of the present invention is the use of an oxygen sensor 10 that is heated, typically by means of resistance heating. A desirable temperature for the sensor 10 is above 600° F. As explained above, it is necessary that the temperature of the sensor 10 be sufficiently constant regardless of the exhaust gas temperature at different engine outputs and speeds, in order to obtain an output signal characteristic in which the sensor 10 output signal varies only with the oxygen concentration in the exhaust gases. Preferably the oxygen sensor 10 is heated by means of resistance heating to insure that the sensor temperature is above 600° F. where it is effective.

Another significant feature of the preferred embodiment of the system of the present invention is the control of the slipstream gases to a constant temperature, maintaining the oxygen sensor 10 at a constant temperature and thus allowing the sensor 10 to provide the accurate signal for the control of the fuel-to-air ratio and optimal effectiveness of the catalytic emission reduction system. In the present invention, a thermostatically controlled valve 14 is used to regulate the temperature of the exhaust gases that pass by the oxygen sensor 10. In the preferred system shown in FIG. 1, the slipstream system includes two streams 26, 28 and the valve 14 blends the two streams 26, 28 of exhaust gas entering the slipstream 24. One stream 28 is cooled by air or liquid through a heat exchanger 12. The other stream 26, however, is not cooled. The thermostatic valve 14 varies the proportion of exhaust gas from each stream 26, 28 to maintain the slipstream 24 at a set temperature between 200° and 500° F.

In the preferred embodiment of the present invention as shown in FIG. 1, the gases in the slipstream 24 then pass through a pressure regulator 16 which maintains a constant set pressure upstream of an orifice 30. For a fixed gas temperature and a fixed pressure drop across the orifice 30, the mass flow rate of the gases through the orifice 30, and hence passing by the oxygen sensor 10, is maintained constant.

Thus, in this embodiment of the system of the present invention, the combination of the heated oxygen sensor 10 and the control of the temperature of the exhaust gas in the slipstream 24 and of the pressure of the temperature-controlled exhaust gas through a pressure regulator 16 and an orifice 30 maintains the proper temperature relationship between the sensor 10 and exhaust gas for maximum conversion efficiency of the catalytic converter. The system of the present invention will effectively eliminate the effect of variable exhaust gas temperature on the oxygen sensor output when the engine speed and load is changed. Consequently, it improves the fuel-air ratio control and the effectiveness of the catalytic emission reduction system.

A signal conditioning unit 18 is provided in the system to permit adjustments for different fuel and different engine settings. The signal from the oxygen sensor 10 is modified in the signal conditioning unit 18 and delivered to the controller 17. By comparing the signal to a set point value, the controller 17 provides a signal to command the fuel control valve 19 to either increase or decrease the fuel flow until the correct air-to-fuel ratio is obtained and the conditioned signal from the oxygen sensor 10 matches the set point value in the controller 17. The adjustment of the signal conditioning unit 18 permits the oxygen concentration to be set at different levels to accommodate for the variation in the optimum oxygen concentration for maximum catalytic emission reduction. For example, the signal conditioning unit 18 will provide for adjustment of the fuel-air ratio for different types of fuel. Moreover, different engine settings can be accommodated, such as spark timing and engine speed. The unit 18 also provides the necessary off-set for the oxygen sensor output when the oxygen sensor 10 is set at different temperatures.

Figure 2:
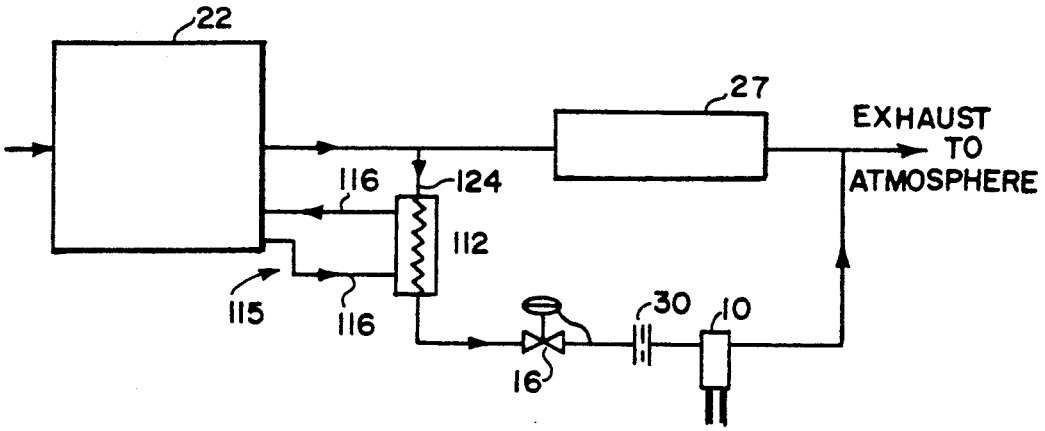
FIG. 2 is a schematic representation of the relevant part of an alternate embodiment of an apparatus according to the present invention.

FIG. 2 illustrates the relevant part of an alternate embodiment of the system of the present invention. In this alternate embodiment, the slipstream system encompasses only one slipstream 124 upstream of the pressure regulator 16. The exhaust gas in the slipstream 124 is cooled in a liquid-cooled heat exchanger 112. The cooling medium 115 for the heat exchanger 112 is supplied at a constant temperature, for example through duct means 116. A preferred cooling medium is the engine coolant (supplied by suitable duct means 116) which is generally maintained at approximately 200° F. The heat exchanger 112 is sized to cool the slipstream 124 to a temperature slightly above the temperature of the cooling medium, for example 5° F. for the case of highest exhaust gas temperature. For the cases of the lower exhaust gas temperatures, the slipstream 124 will be cooled to less than 5° above the temperatures of the cooling medium. The maximum variation of the slipstream gas at the outlet of the heat exchanger 112 can thus be limited to within 5° F. The engine coolant temperature is sufficiently high to prevent condensation in the slipstream 124 and undesirable corrosion problems. The pressure regulator 16 and the orifice 30 provide a constant flow rate, as in the system shown in FIG. 1.

Figure 3:
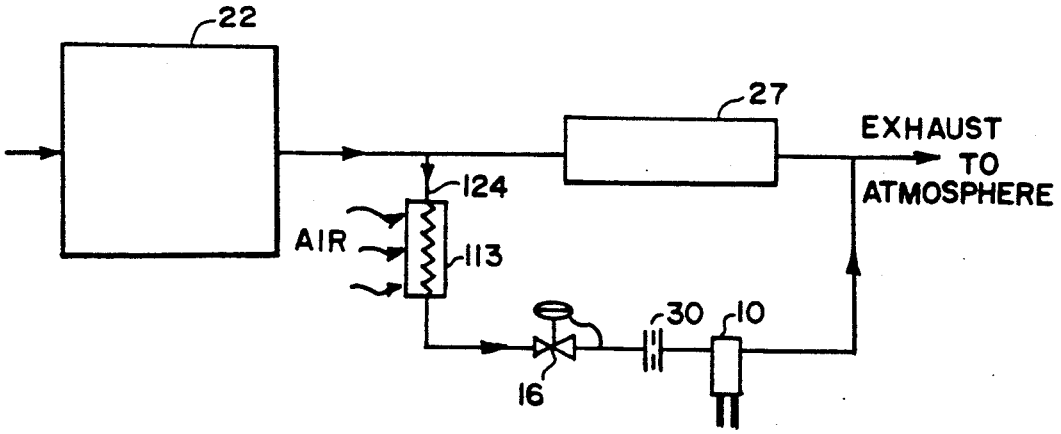
FIG. 3 is a schematic representation of the relevant part of another alternate embodiment of an apparatus according to the present invention.

Additionally, as is shown in FIG. 3, an air cooled heat exchanger 113 can be used in the slipstream 124 rather than a liquid cooled heat exchanger 112 as shown in FIG. 2. Using air as the cooling medium has the disadvantage that its temperature is lower than the dewpoint of the exhaust gases. The slipstream 124 may be cooled to a temperature at which condensation of water vapor may occur. If the slipstream 124 temperature is maintained above the dew point, then because of the large temperature difference between the slipstream 124 and the cooling air the variation in the discharge slipstream temperature will increase when the engine exhaust gas temperature changes. Even though such an arrangement does not maintain the oxygen sensor 10 at a constant temperature, it is a significant improvement over conventional systems where the oxygen sensor 10 is placed directly in the exhaust gas stream.

Figure 4:
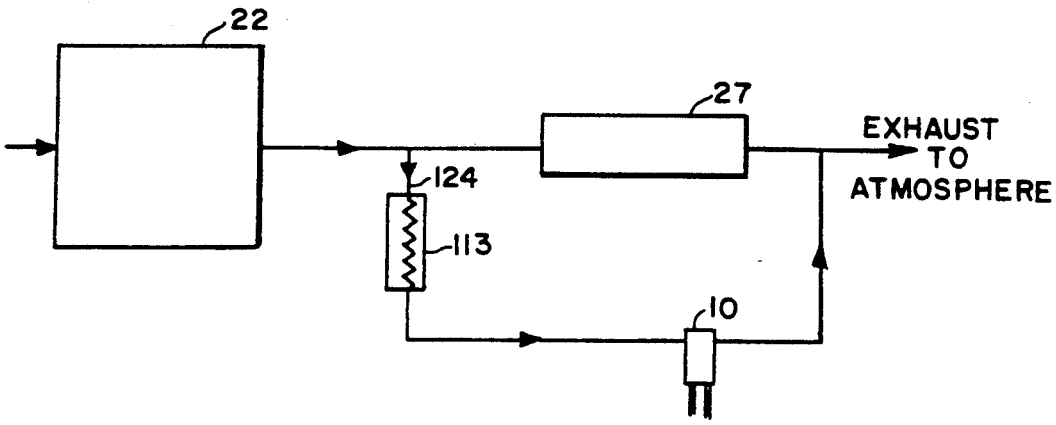
FIG. 4 is a schematic representation of the relevant part of yet another embodiment of an apparatus according to the present invention.

Yet another embodiment of the present invention, shown in FIG. 4, is to employ a system having a heated oxygen sensor 10 and a slipstream 124 with an air-cooled or liquid cooled heat exchanger 113 without the pressure regulator and orifice to control the flow rate. In such a system, the oxygen sensor temperature will vary with engine condition, but to a lesser extent than that in a conventional system where the oxygen sensor 10 is not heated and is placed directly in the exhaust stream. This system shows significant improvement on the performance of the catalytic control system due to improved control of the fuel-to-air mixture ratio.

Figure 5:
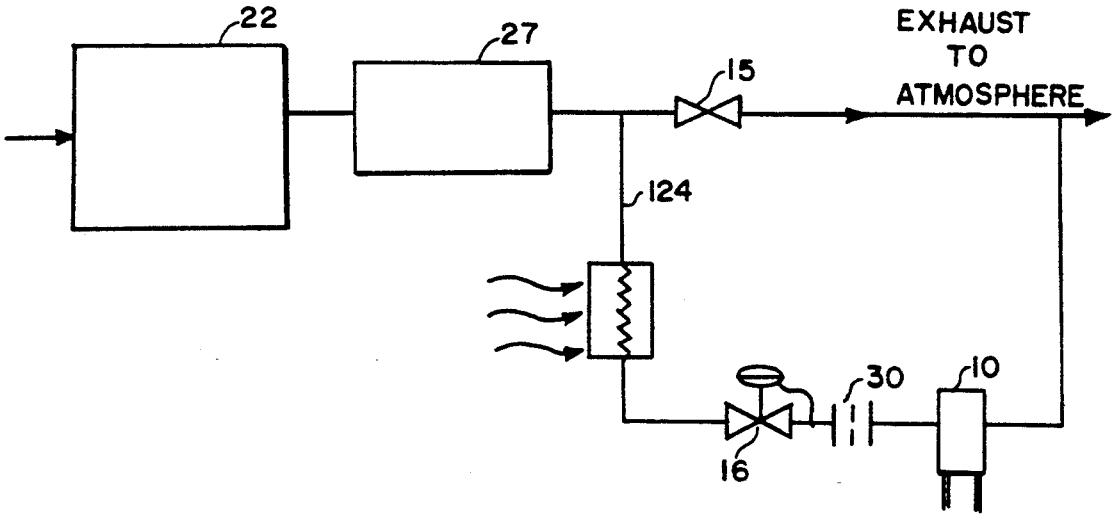
FIG. 5 is a schematic representation of the relevant part of still another embodiment of an apparatus according to the present invention.

FIG. 5 illustrates still another embodiment of the present invention. In the system shown, the fuel-to-air mixture is introduced into the engine 22, and exhaust from the engine 22 passes through the catalytic converter 27. According to this embodiment of the present invention, the stream of exhaust gases is branched after the catalytic converter 27 into the slipstream 124 and then passes through a pressure regulator 16 and across orifice 30 to pass by heated oxygen sensor 10. Means to force the flow of exhaust gases through the slipstream 124 is generally required. Suitable means would be a valve 15 in the exhaust duct system to provide a pressure drop that will drive the flow of exhaust gases through the slipstream 124.

The advantage to this embodiment of the present invention is that all of the exhaust gases exiting the engine 22 can be treated by the catalytic converter 27 while the concepts of the present invention can be utilized to maximize the catalytic converter's conversion efficiency. One skilled in the art can easily determine that the placement of the slipstream 124 after the catalytic converter 27 can be incorporated into any system utilizing the concepts of the present invention, as well as those shown in FIGS. 1–4.

It is to be understood that the embodiments herein illustrated and discussed, and the terms and expressions which have been employed, are by way of illustration and not of limitation and that there is no intention in using any of them to exclude any equivalents of the features shown or described, or portions thereof, since it will be recognized by those skilled in the arts that this invention may be practiced in a wide variety of forms and embodiments without departing from the spirit and scope of this invention.

What is claimed is:

1. A system for improving the conversion efficiency of a catalytic converter in a closed loop fuel control system for an internal combustion engine incorporating an oxygen sensor in the exhaust gas stream comprising:

duct means interconnected with the fuel control system such that a fixed mass rate of the exhaust gases pass through the duct means and form a slipstream, the oxygen sensor disposed in said slipstream;

means for cooling the exhaust gases located in the slipstream;

means for regulating the flow rate in the slipstream to provide a constant flow and pressure of the exhaust gases;

means for heating the oxygen sensor;

wherein the exhaust gases in the slipstream have been regulated as to temperature, flow rate and pressure prior to passing by the heated oxygen sensor.

2. The system of claim 1 wherein the means for regulating the flow rate in the slipstream include a pressure regulator and an orifice.

3. The system of claim 1 wherein said means for cooling the exhaust gasses located in the slipstream is a liquid-cooled heat exchanger and further comprises second duct means for introduction of a liquid cooling medium to the heat exchanger.

4. The system of claim 3 wherein the liquid cooling medium is engine coolant.

5. The system of claim 1 wherein said means for cooling the exhaust gases located in the slipstream is an air-cooled heat exchanger.

6. The system of claim 1 wherein the duct means further comprises:

second duct means positioned before said slipstream, said second duct means dividing the fixed mass rate of the exhaust gases into two streams, one of said two streams including said means for cooling the exhaust gases therein; and means for blending the exhaust gases from each of said two streams in order to regulate the temperature of the exhaust gases in the slipstream.

7. The system of claim 6 wherein the means for regulating the flow rate in the slipstream include a pressure regulator and an orifice.

8. The system of claim 6 wherein said means for cooling the exhaust gases in one of said two streams a liquid cooled heat exchanger and further comprises third duct means for introduction of a liquid cooling medium to the heat exchanger.

9. The system of claim 8 wherein the liquid cooling medium is engine coolant.

10. The system of claim 6 wherein said means for cooling the exhaust gases in one of said streams is an air cooled heat exchanger.

11. A system for improving the conversion efficiency of a catalytic converter in a closed loop fuel control system for an internal combustion engine incorporating an oxygen sensor in the exhaust gas stream comprising:

duct means interconnected with the fuel control system such that a fixed mass rate of the exhaust gases pass through the duct means and form a slipstream, the oxygen sensor disposed in said slipstream;

means for cooling the exhaust gases located in the slipstream;

means for heating the oxygen sensor; and wherein the exhaust gases in the slipstream have been regulated as to temperature prior to passing by the heated oxygen sensor.

12. The system of claim 11 wherein said means for cooling the exhaust gases located in the slipstream is a liquid-cooled heat exchanger and further comprises second duct means for introduction of a liquid cooling medium to the heat exchanger.

13. The system of claim 12 wherein the liquid cooling medium is an engine coolant.

14. The system of claim 11 wherein said means for cooling the exhaust gases located in the slipstream is an air-cooled heat exchanger.

15. The system of claim 11 wherein the duct means further comprises:

second duct means positioned before said slipstream, said second duct means dividing the fixed mass rate of the exhaust gases into two streams, one of said two streams including said means for cooling the exhaust gases therein; and means for blending the exhaust gases from each of said two streams in order to regulate the temperature of the exhaust gases in the slipstream.

16. The system of claim 15 wherein said means for cooling the exhaust gases in one of said two streams is a liquid cooled heat exchanger and further comprises third duct means for introduction of a liquid cooling medium to the heat exchanger.

17. The system of claim 16 wherein the liquid cooling medium is engine coolant.

18. The system of claim 15 wherein said means for cooling the exhaust gases in one of said two streams is an air cooled heat exchanger.

19. A method of improving the air-fuel ratio control system for catalytic exhaust gases emission control in a closed loop fuel control system for an internal combustion engine comprising:

providing a heated oxygen sensor in a slipstream of the exhaust gases;

controlling the temperature and pressure of the exhaust gases passing by the heated oxygen sensor in the slipstream.

20. The method of claim 19 wherein the temperature of the exhaust gases is controlled by:

providing prior to the slipstream means for dividing the exhaust gases into two streams and providing in one of the two streams means for cooling the exhaust gases in one of the two streams and blending a portion of the exhaust gases in each of the two streams in order to maintain the exhaust gases passing to the heated oxygen sensor at a set temperature.

21. The method of claim 19 wherein the pressure of the exhaust gases in the slipstream is controlled by providing a pressure regulator and an orifice immediately before the heated oxygen sensor.

22. The method of claim 19 wherein the temperature of the exhaust gases is controlled by:

providing within the slipstream means for cooling the exhaust gases in the slipstream.

* * * * *